US005412732A

United States Patent [19]

Kanishi et al.

[11] Patent Number: 5,412,732

[45] Date of Patent: May 2, 1995

[54] STEREO SURROUND SYSTEM

[75] Inventors: Kazuhiko Kanishi; Yasushi Nishimura; Kazuaki Sugawara, all of Tokyo, Japan

[73] Assignee: Pioneer Electronic COrporation, Tokyo, Japan

[21] Appl. No.: 3,594

[22] Filed: Jan. 13, 1993

[30] Foreign Application Priority Data

Jan. 16, 1992 [JP] Japan ..... 4-005843

[51] Int. Cl.[6] ..... H04S 5/02

[52] U.S. Cl. ..... 381/18; 381/24; 381/63

[58] Field of Search ..... 381/17, 18, 86, 63, 381/1, 24

[56] References Cited

U.S. PATENT DOCUMENTS 3,997,725 12/1976 Gerzon ..... 381/21
4,757,544 7/1988 Guy ..... 381/90
4,817,149 3/1989 Myers ..... 381/63
5,161,196 11/1992 Ferguson ..... 381/17

*Primary Examiner*—Forester W. Isen
*Attorney, Agent, or Firm*—Kane, Dalsimer, Sullivan, Kurucz, Levy, Eisele and Richard

[57] ABSTRACT

Stereo audio signals of right and left channels are inputted to a stereo surround system. The stereo surround system is provided with: a right side speaker group including at least two speakers arranged vertically; and a left side speaker group arranged at a left side of the right side speaker group, and including at least two speakers arranged vertically. The stereo surround system is further provided with a process device, coupled to the right side speaker group and the left side speaker group, for processing the inputted stereo audio signal of the right channel to generate at least two kinds of the surround signals to the right side speaker group, and for processing the inputted stereo audio signal of the left channel to generate at least two kinds of the surround signals to the left side speaker group.

14 Claims, 14 Drawing Sheets

STEREO SURROUND SYSTEM

BACKGROUND OF THE INVENTION

1. Field of the Invention

The present invention is related with a stereo surround system which expands the stereo reproduction sound field.

2. Description of the Related Art

There are various types of audio visual apparatuses. In order to make more real the feeling of concert hall presence of reproduction sound seized as the listener's spatial impression, various sound field reproduction (or creation) technologies are developed. This is known as a surround system. "A feeling of the expanded or spread sounds" is one of the sensuous elements for reproducing the feeling of concert hall presence of sound. The stereo reproduction sound field expansion apparatus (hereinbelow, it is called as a stereo surround system) is known as signal process means for expressing this feeling of spread sound.

A stereo reproduction apparatus using a stereo wide circuit will be explained as an example of this stereo surround system, hereinbelow.

The process unit which expands the sound field in the horizontal direction, consists of the stereo wide circuit in this stereo reproduction apparatus. The right channel stereo audio signal (hereinbelow, it is called as a right signal R) and the left channel stereo audio signal (hereinbelow, it is called as a left signal L) which should be reproduced, are inputted into the process unit which expands the sound field in the horizontal direction.

A horizontal direction sound field expansion process unit, that is to say, a process unit for expanding the sound field in the horizontal direction, picks up the delay component and the reverberation component between the channels originally included in the inputted right signal R and left signal L, as a difference signal between the channels, and gives a phase delay process to this picked up difference signal, by a phase delay circuit etc. Then, it adds the processed signal, by arbitrary ratios to the original right signal R and the original left signal L, respectively, and outputs them as an expanded right signal RW and an expanded left signal LW, which will create pseudo-expanded sound.

The expanded right signal RW and expanded left signal LW are power-amplified respectively by an amplifier, and are supplied to a corresponding right speaker SPR and a corresponding left speaker SPL. At this time, the sound emitted from the right speaker SPR and the left speaker SPL reaches both of listeners' ears. The sound acts so that a listener may feel the sound which is spread wider in the right and left direction than the actual arrangement interval of the right speaker SPR and the left speaker SPL.

For example, there are Japanese Patent Publication No. (Hei) 3-12520, Japanese Patent Publication No. (Hei) 3-8640, etc. disclosing such a stereo wide circuit.

In this manner, the feeling of the spread sounds to the right and left direction can be obtained by the reproduction sound of a stereo surround system. However, the feeling of the spread sounds to the direction other than the right and left direction cannot be obtained by the above mentioned techniques. Therefore, as compared with the real case where the listener listens to an actual live performance etc., the above mentioned apparatus has the problem that a feeling of the spread sounds is not really obtained.

SUMMARY OF THE INVENTION

It is therefore an object of the present invention to provide a stereo surround system which can give to a listener, a more natural feeling of spread sound (feeling of a sound field) and a more natural feeling of concert hall presence.

According to the present invention, the above mentioned object can be achieved by a first stereo surround system, to which stereo audio signals of right and left channels are inputted. The first stereo surround apparatus is provided with: a right side speaker group including at least two speakers arranged vertically; a left side speaker group arranged at a left side of the right side speaker group, and including at least two speakers arranged vertically; and a process device, coupled to the right side speaker group and the left side speaker group, for processing the inputted stereo audio signal of the right channel to generate at least two kinds of the surround signals to the right side speaker group, and for processing the inputted stereo audio signal of the left channel to generate at least two kinds of the surround signals to the left side speaker group.

In the first stereo surround system, the surround signals are supplied to the right side speaker group, while the surround signals are supplied to the left side speaker group. Thus, on one hand, pseudo-expanded sound waves are produced by the surround signals at the right side speaker group. On the other hand, pseudo-expanded sound waves are produced by the surround signals at the left side speaker group. This feature of the present invention is quite different from the aforementioned related art cases, in which the surround process is horizontally performed with respect to the right and left speakers. Therefore, according to the present invention, the surround process can be performed in a three dimensional manner, and ampler feeling of concert hall presence and sound field, can be given to a listener.

In one aspect of the present invention, the process device includes a device for performing a process to expand a sound field of the right side speaker group in a vertical direction, and a device for performing a process to expand a sound field of the left side speaker group in a vertical direction. Thus, it is possible to give a listener a more natural feeling of sound field and concert hall presence by the pseudo-expanded sound in the vertical direction.

In another aspect of the present invention, the right side speaker group includes a right upper speaker and a right lower speaker, while the left side speaker group includes a left upper speaker and a left lower speaker. In this case, the process device includes a device for performing a process to expand a sound field between the right upper speaker and the left lower speaker, and a device for performing a process to expand a sound field between the right lower speaker and the left upper speaker. Thus, it is possible to give a listener a more natural feeling of sound field and concert hall presence by the expanded sound in the inclined direction.

In another aspect of the present invention, the right side speaker group includes a right front speaker and a right rear speaker, while the left side speaker group includes a left front speaker and a left rear speaker. In this case, the process device includes a device for performing a process to expand a sound field between the right front speaker and the right rear speaker, and a device for performing a process to expand a sound field between the left front speaker and the left rear speaker. Thus, it is possible to give a listener a more natural feeling of sound field and concert hall presence by the expanded sound in the front and rear direction.

In the present invention, the process device may includes a simulated stereo circuit, a delay circuit, or an initial reflective sound generation device, for example. The simulated stereo circuit is adapted to give a phase difference to one of the surround signals for each of the right and left side speaker groups with respect to another of the surround signals for each of the right and left side speaker groups, respectively. The delay circuit is adapted to give a time delay to one of the surround signals for each of the right and left side speaker groups with respect to another of the surround Signals for each of the right and left side speaker groups, respectively. The initial reflective sound generation device is adapted to add a signal component corresponding to an initial reflective sound to one of the surround signals for each of the right and left side speaker groups. In this manner, it is possible by use of various devices to pseudo-expand the sound of each of the right and left side speaker groups.

In the present invention, an amplifier device may be disposed between the process device and each of the right and left side speaker groups, for amplifying the surround signals.

According to the present invention, the above mentioned object can be also achieved by a second stereo surround system, to which stereo audio signals of right and left channels are inputted, for generating surround signals to a right side speaker group and a left side speaker group. This second stereo surround system includes: a right side process device for processing the inputted stereo audio signal of the right channel to generate at least two kinds of surround signals to the right side speaker group; and a left side process device for processing the inputted stereo audio signal of the left channel to generate at least two kinds of surround signals to the left side speaker group.

Accordingly, just by connecting this second stereo surround system to the right side speaker group including at least two speakers arranged vertically, and to the left side speaker group including at least two speakers arranged vertically, the above mentioned configuration of the first stereo surround system of the present invention can be realized by use of existing speakers, and thus the same effect and advantage as those in the first stereo surround system, can be effectively and economically achieved.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Preferred embodiments of the present invention will be explained in detail hereinbelow, with reference to the drawings.

First Embodiment

The first embodiment of the present invention is explained with reference to FIGS. 1 to 5.

Figure 1:
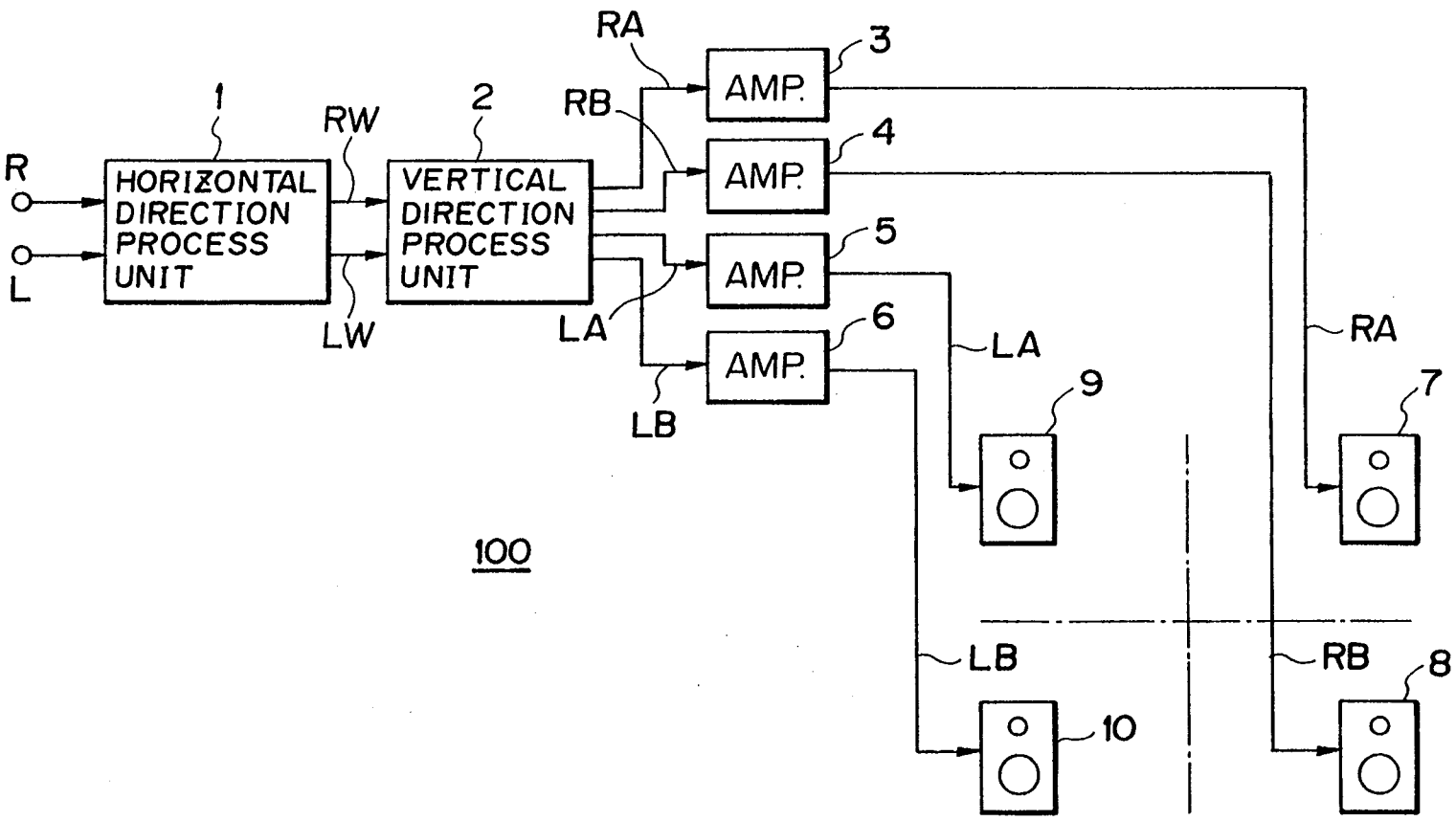
FIG. 1 is a block diagram which indicates a constitution of a first embodiment.

The constitution of a stereo reproduction apparatus employing a stereo surround system as a first embodiment according to the present invention, is shown in FIG. 1.

A stereo reproduction apparatus 100 has a horizontal direction sound field expansion process unit 1, a vertical direction sound field expansion process unit 2, and amplifiers AMPs 3 to 6.

Figure 2:
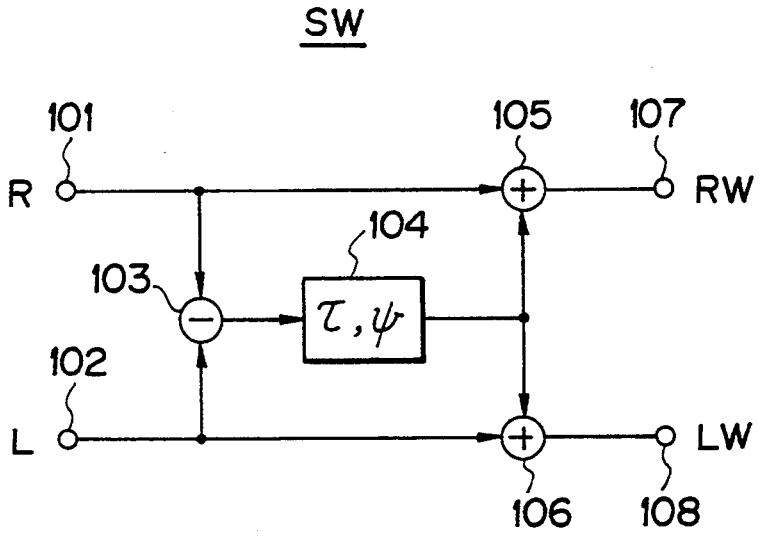
FIG. 2 is a block diagram which indicates a constitution of a stereo wide circuit of the first embodiment.

The horizontal direction sound field expansion process unit 1 is provided with a stereo wide circuit shown in FIG. 2. The vertical direction sound field expansion process unit 2 is provided with a simulated stereo circuit shown in FIG. 3, which has an operation characteristic shown in FIGS. 4 and 5, as explained in detail later.

In FIG. 1, the horizontal direction sound field expansion process unit 1 expands the sound field in the horizontal direction. A right signal R and a left signal L which should be reproduced, are inputted into this horizontal direction sound field expansion process unit 1. The horizontal direction sound field expansion process unit 1 picks up the delay component and the reverberation component between the channels included in the originally inputted right signal R and left signal L, as a difference signal between channels, and gives a phase delay process to this picked up difference signal, by a phase delay circuit etc. By adding the phase delay by arbitrary ratios to the original right signal R and left signal L, the horizontal direction sound field expansion process unit 1 outputs the expanded right signal RW and the expanded left signal LW which will create pseudo-expanded sound as for the horizontal direction.

The expanded right signal RW and the expanded left signal LW are inputted into the vertical direction sound field expansion process unit 2.

The vertical direction sound field expansion process unit 2 generates, from the inputted expanded right signal RW, an upper right signal RA and a lower right signal RB, in a pseudo-generating manner as described in detail later. On the other hand, the vertical direction sound field expansion process unit 2 generates, from the inputted expanded left signal LW, an upper left signal LA and a lower left signal LB. The upper right signal RA is power-amplified by an amplifier AMP 3, and is supplied to an upper right speaker 7. The lower right signal RB is power-amplified by an amplifier AMP 4, and is supplied to a lower right speaker 8. The upper left signal LA is power-amplified by an amplifier AMP 5, and is supplied to an upper left speaker 9. The lower left signal LB is power-amplified by an amplifier AMP 6, and is supplied to a lower left speaker 10.

At this time, the sounds emitted from the upper right speaker 7, the lower right speaker 8, the upper left speaker 9, and the lower left speaker 10 reach both of listeners' ears.

Figure 6:
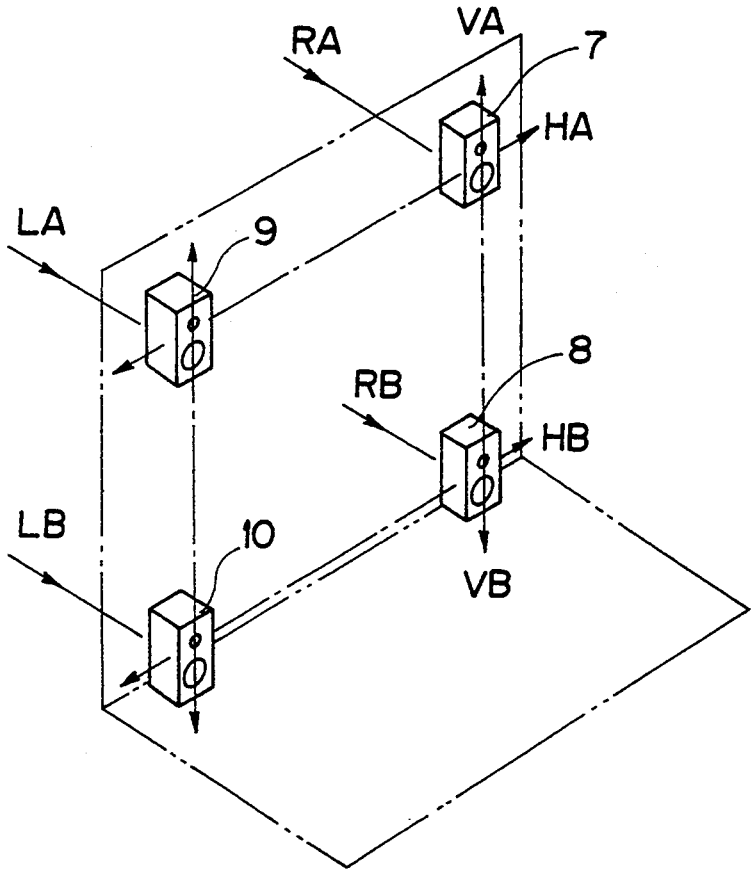
FIG. 6 is a figure explaining an operation of the first embodiment.

As shown by arrows HA and HB in FIG. 6, the sound acts so that the listener may feel the sound spread wider in the right and left direction than the actual arrangement interval between the right speakers 7, 8, and the left speakers 9, 10. As shown in arrows VA and VB in FIG. 6, the sound acts so that the listener may feel the sound spread wider in the upper and lower direction than the actual arrangement interval between the upper speakers 7, 9 and the lower speakers 8, 10. As the result, it can give to a listener the ampler feeling of concert hall presence and three dimensional sound field.

With reference to FIG. 2, the horizontal direction sound field expansion process unit will be explained in detail, hereinbelow.

The horizontal direction sound field expansion process unit 1 of FIG. 1, is provided with a stereo wide circuit SW shown in FIG. 2. The right signal R and the left signal L from the exterior are inputted through input terminals 101 and 102, respectively. The right signal R inputted through the input terminal 101, is inputted respectively into a subtracter 103 and an adder 105. On the other hand, the left signal L inputted through the input terminal 102, is inputted respectively into a subtracter 103 and an adder 106.

The subtracter 103 generates the difference signal indicating the difference between the inputted right signal R and left signal L. The subtracter 103 outputs the difference signal to a phase delay circuit 104. The phase delay circuit 104 applies phase delay with delay time $\tau$ and phase amount $\psi$ to the inputted difference signal. The phase delay circuit 104 outputs the result respectively to the adder 105 and the adder 106 as a phase delay difference signal.

The adder 105 adds the phase delay difference signal by an arbitrary ratio to the inputted right signal R, and outputs it as the expanded right signal RW to an output terminal 107.

The adder 106 adds the phase delay difference signal by an arbitrary ratio to the inputted left signal L, and outputs it as the expanded left signal LW to an output terminal 108.

Thereby, the right signal R and the left signal L inputted into the stereo wide circuit SW, are processed to pseudo-expand the sound field in the horizontal direction.

Next, with reference to FIG. 3, the vertical direction sound field expansion process unit 2 will be explained in detail hereinbelow. Here, it is explained only as for the sound field expansion process of the vertical direction of the right hand side channel in the following explanation for simplification of explanation. However, it is understood that the same explanation is valid for the left hand side channel.

Figure 3:
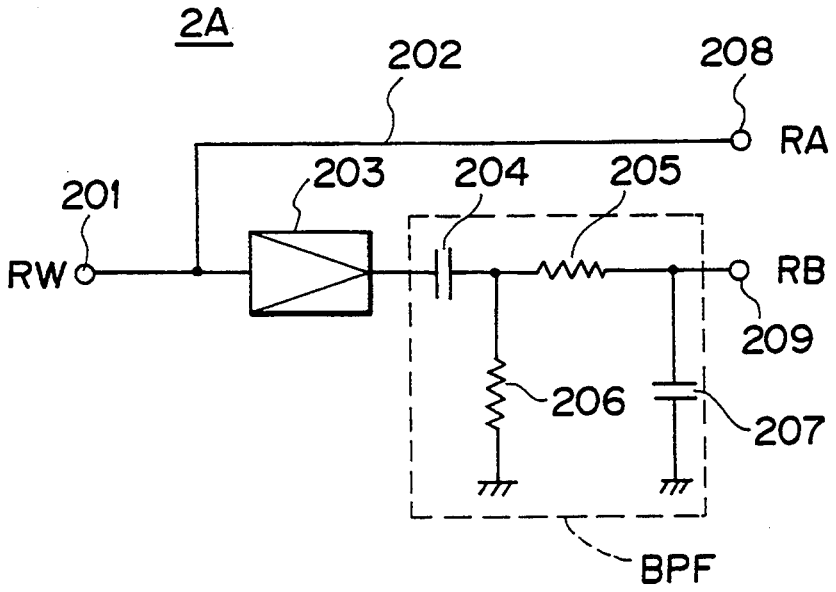
FIG. 3 is a block diagram which indicates a constitution of a simulated stereo circuit of the first embodiment.

The vertical direction sound field expansion process unit 2 of FIG. 1, has a simulated stereo circuit 2A shown in FIG. 3.

In FIG. 3, the expanded right signal RW is inputted through an input terminal 201 from the horizontal direction sound field expansion process unit 1.

Figure 4:
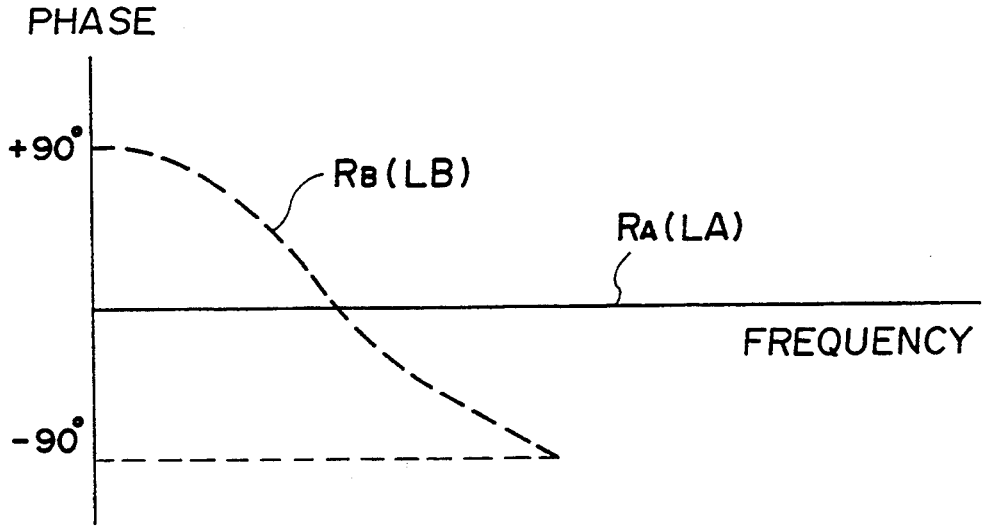
FIG. 4 is a figure explaining an operation of the simulated stereo circuit of FIG. 3.

A portion of the expanded right signal RW inputted through the input terminal 201, is outputted as the upper right signal RA from an output terminal 208 through a signal line 202. The other portion of the inputted expanded right signal RW, is inputted into an amplifier 203, and is amplified and outputted at a rate equivalent to the attenuation amount of a band path filter BPF at the next stage. The band path filter BPF has a high path filter and a low path filter. The high path filter includes a capacitor 204 and a resistance 206. The low path filter includes a resistance 205 and a capacitor 207. The delay based on the characteristic of the band path filter BPF is given to the lower right signal RB which is the output signal of the band path filter BPF. Then, it is outputted through an output terminal 209. More concretely, these upper right signal RA and lower right signal RB are made different in their phases, as shown in FIG. 4, for example. Namely, the lower right signal RB changes in its phase up to $-90$ degrees from $+90$ degrees, while the phase difference of the lower right signal RB with respect to the upper right signal RA, changes up to $-90$ degrees from $+90$ degrees.

In this manner, the right signal R is changed to a signal for pseudo-expanded stereo sound in the vertical direction by shifting the phase between the upper right signal RA and the lower right signal RB. For this reason, the reproduction sound of the right channel is expanded about the sound field in the vertical direction.

By using the same simulated stereo circuit, as for the left hand side channel, the left Signal L is divided into the upper left signal LA and the lower left signal LB. The left signal L is changed to a signal for pseudo-expanded stereo sound by shifting the phase of the upper left signal LA and the lower left signal LB. Thus, the reproduction sound of the left channel is expanded about the sound field in the vertical direction.

Figure 5:
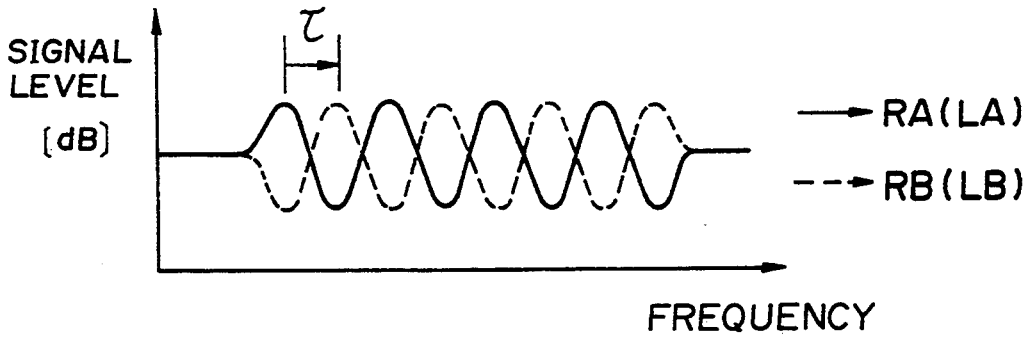
FIG. 5 is a figure explaining other operation of the simulated stereo circuit of FIG. 3.

FIG. 5 indicates other examples of the characteristic. The phases of the upper right signal RA and the lower right signal RB, are shifted 90 degrees to each other. Such a characteristic can be realized by, for example, using the comb type filter.

Second Embodiment

Figure 7:
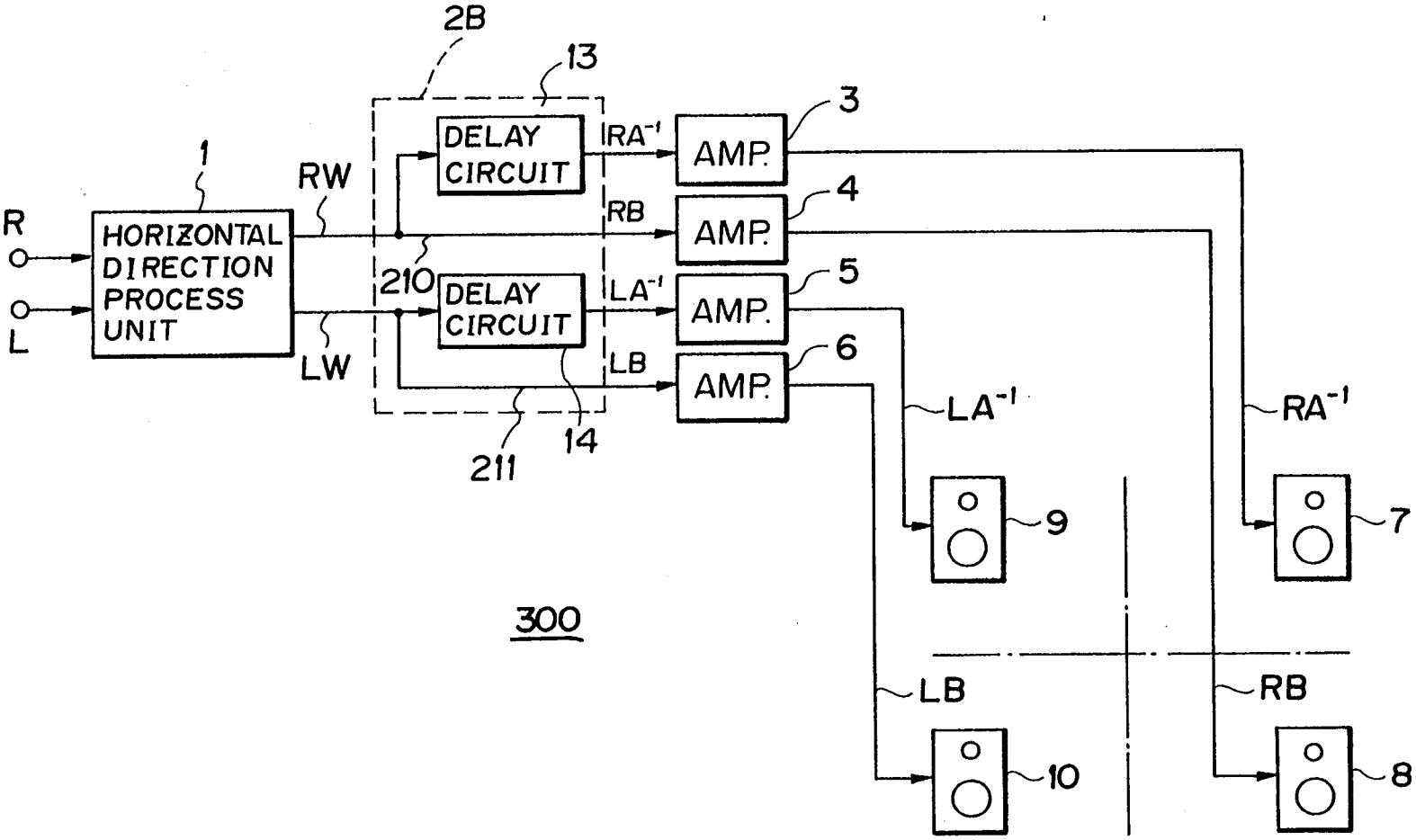
FIG. 7 is a block diagram which indicates a constitution of a second embodiment.

Next, the second embodiment of the present invention will be explained in detail with reference to FIG. 7. This second embodiment is an example provided with a delay circuit, in place of the simulated stereo circuit 2A of the vertical direction sound field expansion process unit 2 in the first embodiment, which performs the sound field expansion of the vertical direction by giving delay to the inputted expanded signal RW and LW. In FIG. 7, the same elements as those in FIG. 1, carry the same reference numerals, and the explanations thereof are omitted.

In FIG. 7, a stereo reproduction apparatus 200 as a second embodiment, is especially provided with a vertical direction sound field expansion process unit 2B. The vertical direction sound field expansion process unit 2B has a delay circuit 13, a signal line 210, a delay circuit 14, and a signal line 211. The delay circuit 13 delays the expanded right signal RW, generates an upper right delay signal $RA^{-1}$, and outputs it to the amplifier 3. The signal line 210 outputs the expanded right signal RW to the amplifier 4 as the lower right signal RB without processing. The delay circuit 14 delays the expanded left signal LW, generates an upper left delay signal $LA^{-1}$, and outputs it to the amplifier 5. The signal line 211 outputs the expanded left signal LW to the amplifier 6 as the lower left signal LB without processing.

By constituting in this manner, the upper right delay signal $RA^{-1}$ can be delayed with respect to the lower right signal RB (=the expanded right signal RW). The upper left delay signal $LA^{-1}$ can be delayed with respect to the lower left signal LB (=the expanded left signal LW). Reproduction sound of the right channel and the left channel is expanded about the sound field in the vertical direction in the similar manner as in the case of employing the simulated stereo circuit of the first embodiment.

Third Embodiment

Figure 8:
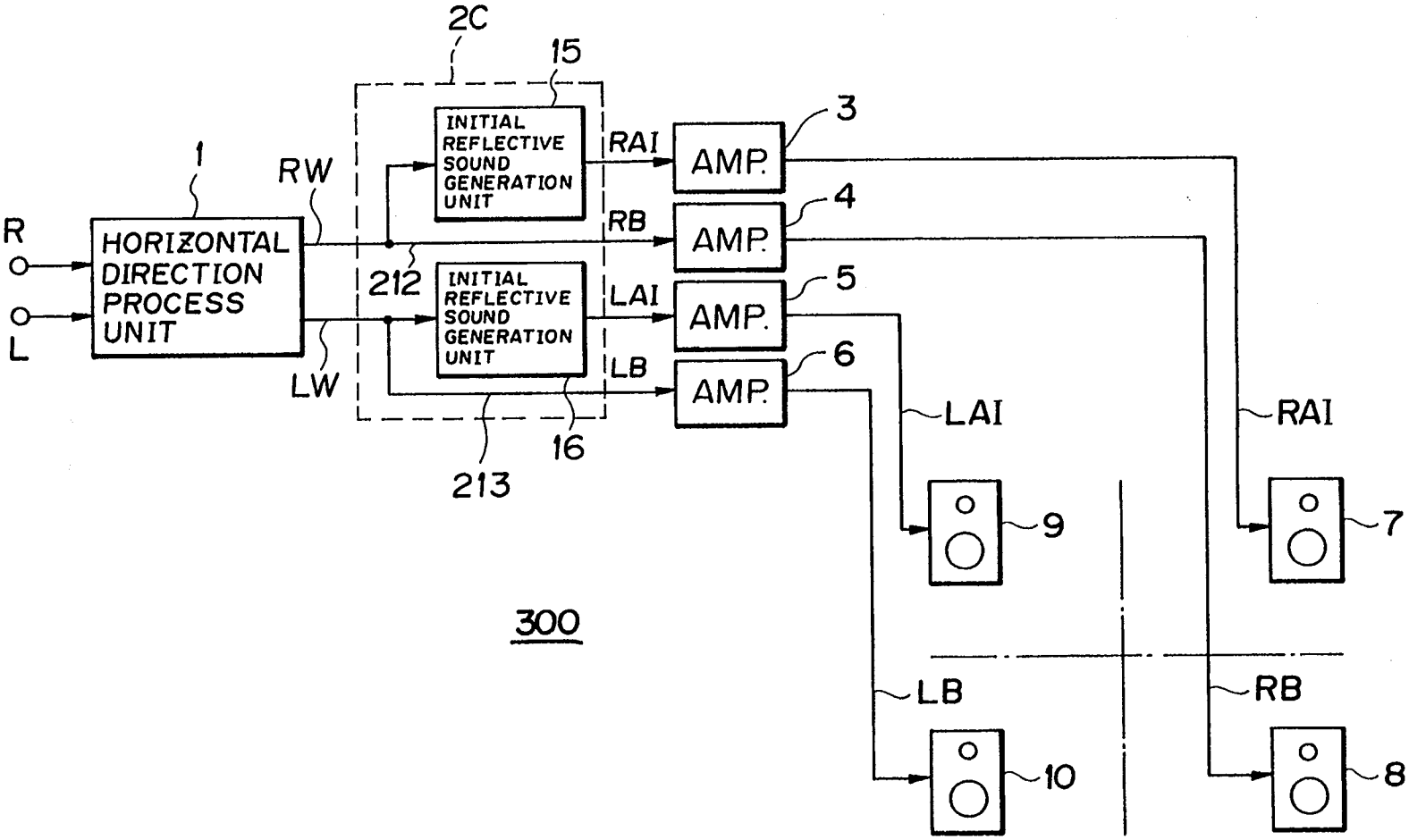
FIG. 8 is a block diagram which indicates a constitution of a third embodiment.

Next, the third embodiment of the present invention will be explained in detail with reference to FIGS. 8 and 9. This third embodiment is an example provided with an initial reflective sound generation unit, in place of the delay circuit of the vertical direction sound field expansion process unit in the second embodiment, which generates an initial reflective sound from the inputted expanded signals RW and LW. In FIG. 8, the same elements as those in FIG. 1 or 7, carry the same reference numerals, and the explanations thereof are omitted.

Firstly, the initial reflective sound is explained. The initial reflective sound is a reflective sound which arrives succeedingly after the direct sound within about 50 msec (mili-second) or less, and has such a character that it increases the strength of the direct sound in the hearing sense. This initial reflective sound is the important factor which gives the feeling of concert hall presence and sound field, i.e. a pseudo-feeling in an actual concert hall.

Therefore, by adding the initial reflective sound to the direct sound, it becomes possible to give the feeling of concert hall presences, and the feeling of the sound field, so that the listener would feel as if he were in the actual concert hall.

In FIG. 8, a stereo reproduction apparatus 300 as a third embodiment, is especially provided with a vertical direction sound field expansion process unit 2C. The vertical direction sound field expansion process unit 2C has an initial reflective sound generation unit 15, a signal line 212, an initial reflective sound generation unit 16, and a signal line 213.

The initial reflective sound generation unit 15 generates the initial reflective sound from the expanded right signal RW. By adding it to the expanded right signal RW, the initial reflective sound generation unit 15 generates a mixed upper right signal RAI, and outputs it to the amplifier 3. The signal line 212 outputs the expanded right signal RW to the amplifier 4 as the lower right signal RB without processing. The initial reflective sound generation unit 16 generates the initial reflective sound from the expanded left signal LW. By adding it to the expanded left signal LW, the initial reflective sound generation unit 16 generates the mixed upper left signal LAI, and outputs it to the amplifier 5. The signal line 213 outputs the expanded left signal LW to the amplifier 6 as the lower left signal LB without processing.

Then, the mixed upper right signal RAI is power-amplified by the amplifier AMP 3, and is supplied to the upper right speaker 7. The lower right signal RB is power-amplified by the amplifier AMP 4, and is supplied to the lower right speaker 8. The mixed upper left signal LAI is power-amplified by the amplifier AMP 5, and is supplied to the upper left speaker 9. The lower left signal LB is power-amplified by the amplifier AMP 6, and is supplied to the lower left speaker 10.

In this manner, the initial reflective sound is added to the expanded right signal RW to generate the mixed upper right signal RAI, so that a signal for pseudo-expanded stereo sound in the vertical direction is obtained. The initial reflective sound is added to the expanded left signal LW to generate the mixed upper left signal LAI, so that a signal for pseudo-expanded stereo sound in the vertical direction is obtained. The reproduction sound of the right channel and the left channel is pseudo-expanded about the sound field in the vertical direction. It becomes possible to obtain the feeling of concert hall presence and three dimensional sound field, as in the actual concert hall.

Figure 9:
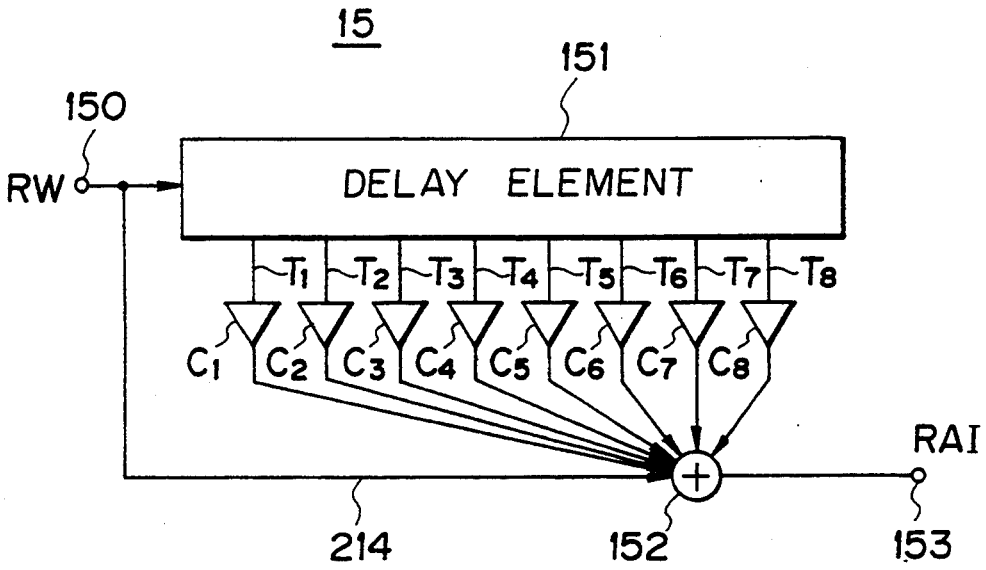
FIG. 9 is a block diagram which indicates a constitution of an initial reflective sound Generation unit of the third embodiment.

FIG. 9 shows one example of the constitution of the initial reflective sound generation unit 15 (16). Only the constitution of the initial reflective sound generation unit 15 is explained in the following explanation for the sake of simplification of explanation.

The expanded right signal RW is inputted through an input terminal 150 into the initial reflective sound generation unit 15. This inputted expanded right signal RW is inputted into an adder 152 through an delay element 151 and an signal line 214, respectively. The expanded right signal RW inputted into the delay element 151, is delayed with delay time t1, . . . , t8 ($t1<t2< \ldots <t7<t8$). They are outputted to multipliers C1, . . . , C8 respectively, as delay output signals T1, . . . , T8. The multipliers C1, . . . , C8 multiply predetermined coefficients co1, . . . , co8 respectively, to the inputted delay output signals. The multipliers C1, . . . , C8 output the results to the adder 152 as multiplication result signals. The adder 152 obtains the sum of all multiplication result signals and expanded right signal RW ($=(co\times T1+ \ldots +co8\times T8)+RW$).

Figure 10:
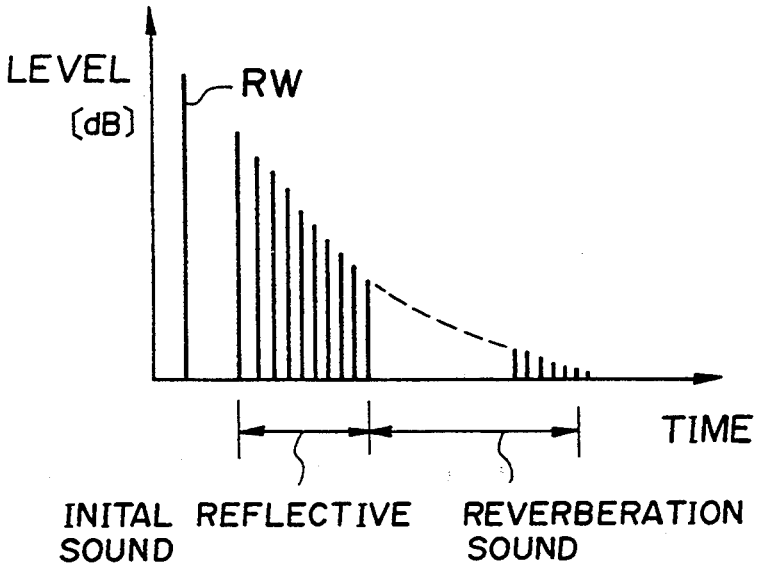
FIG. 10 is a figure explaining the sound propagation characteristic of the third embodiment.

As shown in the sound propagation characteristic (initial reflective sound) of FIG. 10, the adder 152 outputs the mixed upper right signal RAI as an initial reflective sound signal to the amplifier 3 through an output terminal 153. Therefore, the reproduction signal to which the initial reflective sound is added, is outputted from the upper right speaker 7. As the result, the listener can get reproduction sound with the feeling of concert hall presence and three dimensional sound field.

In the above third embodiment, the initial reflective sound generation unit outputs the addition result of the initial reflective sound and original sound (=the expanded right signal RW). However, it may be constituted so that it outputs only the initial reflective sound. In this case, the signal line 214 is unnecessary.

The above third embodiment adds only the initial reflective sound. However, in addition to the reflective sound generation circuit, a known reverberation sound generation circuit may be employed. By constituting in this manner, it becomes possible to obtain reproduction sound with the more feeling of concert hall presence and three dimensional sound field. FIG. 10 shows a sound propagation characteristic in this case (reverberation sound). As a known example of the reverberation sound Generation circuit, there is, for example, a circuit disclosed in Japanese Patent Application No.(Hei) 2-147975 etc.

Fourth Embodiment

Figure 11:
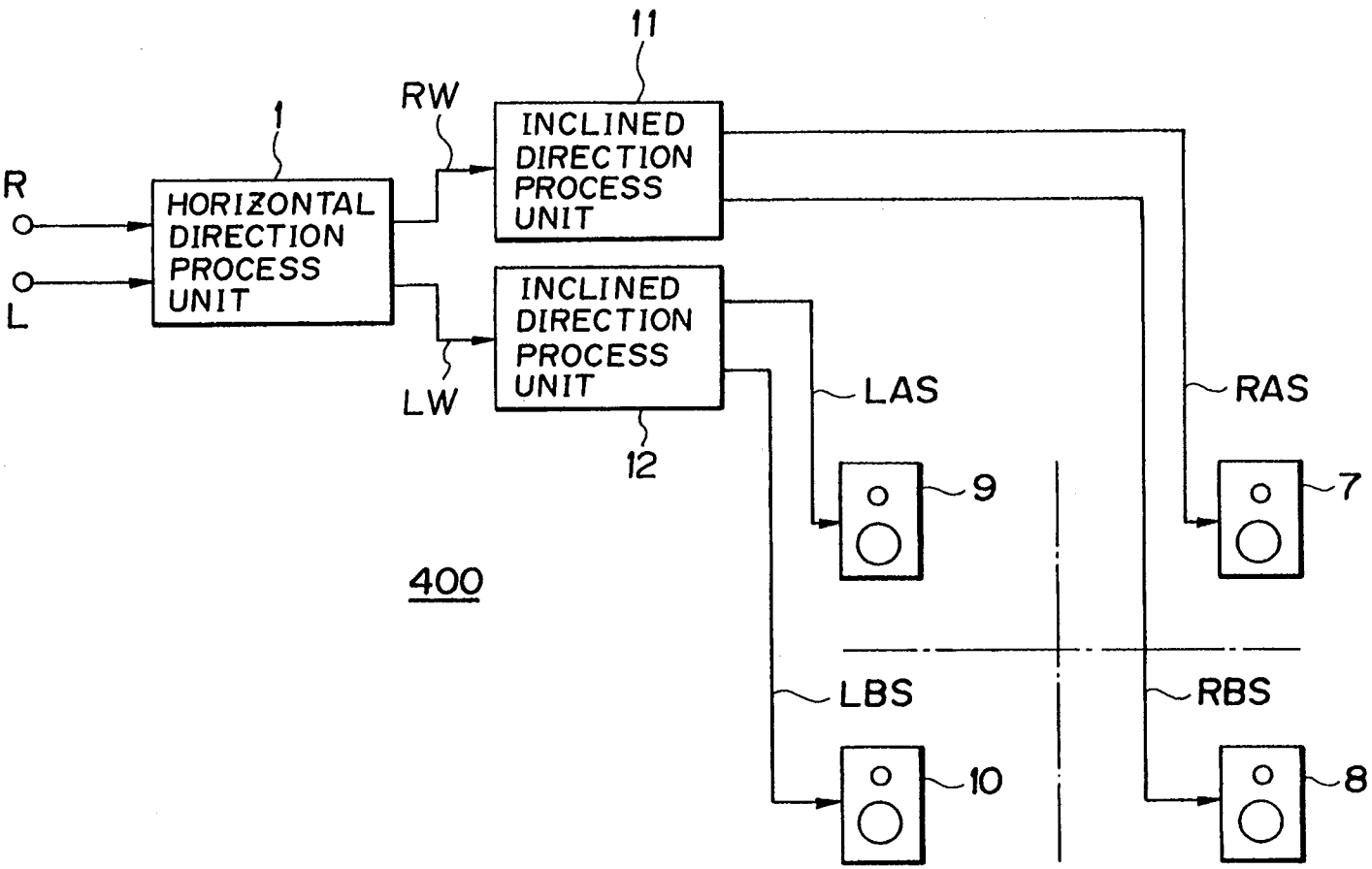
FIG. 11 is a block diagram which indicates a constitution of a fourth embodiment.

Next, the fourth embodiment of the present invention will be explained in detail with reference to FIG. 11. In FIG.11, the same elements as those in FIG. 1 or 7 carry the same reference numerals and the explanations thereof are omitted.

In FIG. 11, a stereo reproduction apparatus 400 as a fourth embodiment, is especially provided with inclined direction sound field expansion process units 11 and 12, in place of the vertical direction sound field expansion process unit in the first embodiment. The inclined direction sound field expansion process units 11 and 12 expand the sound field to the inclined direction on the basis of inputted expanded signals RW and LW, respectively.

The inclined direction sound field expansion process unit 11 has the same structure as that of the simulated stereo circuit 2A shown in FIG. 3. The expanded right signal RW is inputted through the input terminal from the horizontal direction sound field expansion process unit 1 into the inclined direction sound field expansion process unit 11. A portion of the expanded right signal RW inputted through the input terminal, is outputted as a simulated lower right signal RBS (which corresponds to the upper right signal RA in FIG. 3) from the output terminal through the signal line. The other portion of the inputted expanded right signal RW, is inputted into the amplifier. It is amplified and outputted at a rate equivalent to the attenuation amount of the band path filter at the next stage. A simulated upper right signal RAS (which corresponds to the lower right signal RB in FIG. 3) which is the output signal of the band path filter, is outputted through the output terminal.

These simulated upper right signal RAS and simulated lower right signal RBS, are the signals which are equal in amplitude to each other, and are shifted in phase by 90 degrees to each other, in the same manner as the case of the upper right signal RA and the lower right signal RB shown in FIG. 4.

On the other hand, the inclined direction sound field expansion process unit 12 has the same circuit constitution as the simulated stereo circuit 2A shown in FIG. 3. The inclined direction sound field expansion process unit 12 has constitution in which the output terminals are interchanged with respect to the inclined direction sound field expansion process unit 11. More concretely, the expanded left signal LW is inputted through the input terminal from the horizontal direction sound field expansion process unit 1 into the inclined direction sound field expansion process unit 12. A portion of this inputted expanded left signal LW is outputted as the simulated upper left signal RAS (which corresponds to the lower left signal LB in FIG. 3) from the output terminal through the signal line. The other portion of this inputted expanded left signal LW, is inputted into the amplifier. It is amplified and outputted at a rate equivalent to the attenuation amount of the band path filter at the next stage. The simulated lower left signal LBS (which corresponds to upper left signal LA in FIG. 3) which is the output signal of the band path filter, is outputted through the output terminal. These simulated upper left signal LAS and simulated lower left signal LBS, are the signals which are equal in amplitude to each other and are shifted in phase to each other by 90 degrees, in the same manner as the case of the upper right signal RA and the lower right signal RB shown in FIG. 4.

Figure 12:
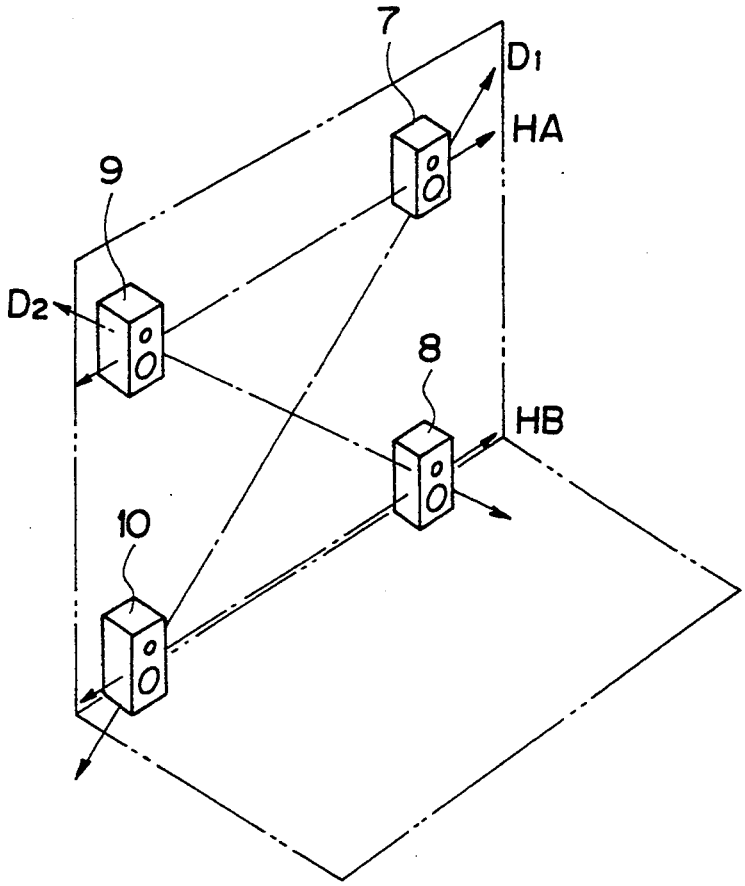
FIG. 12 is a figure explaining an operation of the fourth embodiment.

In this manner, the sound field is pseudo-expanded in the inclined direction as shown by arrows D1 and D2 in FIG. 12 by delaying the phase of the simulated upper right signal RAS with respect to the phase of the simulated lower right signal RBS and by delaying the phase of the simulated lower left signal LBS with respect to the phase of the simulated upper left signal LAS. The reproduction with ampler feeling of concert hall presence, can be performed.

Fifth Embodiment

Next, the fifth embodiment of the present invention will be explained in detail with reference to FIGS. 13 to 16.

Figure 13:
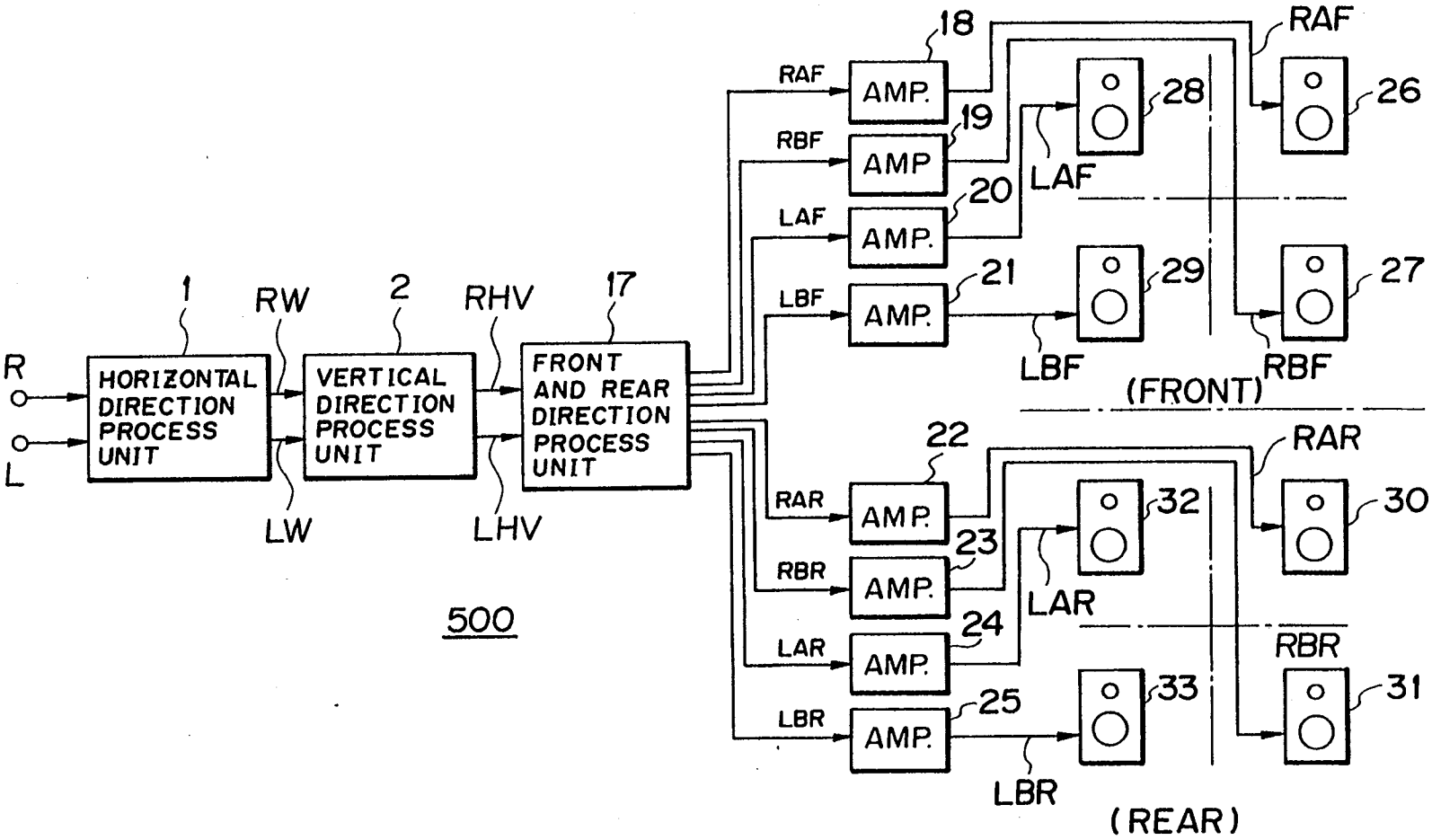
FIG. 13 is a block diagram which indicates a constitution of a fifth embodiment.

In FIG. 13, a stereo reproduction apparatus 500 as a fifth embodiment, is especially provided with a front and rear direction sound field expansion process unit 17, a front amplifier group i.e. amplifiers AMPs 18 to 21, a front speaker group i.e. speakers 26 to 29, a rear amplifier group i.e. amplifiers AMPs 22 to 25, and a rear speaker group i.e. speakers 30 to 33, in addition to the constitution of the horizontal direction sound field expansion process unit 1 and the vertical direction sound field expansion process unit 2 in the first embodiment. Thereby, it can perform not only the sound field expansion in the listener's horizontal and vertical directions but also the sound field expansion in the front and rear direction. In FIG. 13, the same elements as those in FIG. 1 or 7, carry the same reference numerals, and the explanations thereof are omitted.

In FIG. 13, the stereo reproduction apparatus 500 has a horizontal direction sound field expansion process unit 1, a vertical direction sound field expansion process unit 2, and a front and rear direction sound field expansion process unit 17.

The horizontal direction sound field expansion process unit 1 expands the sound field in the horizontal direction. The right signal R and the left signal L which should be reproduced, are inputted into the horizontal direction sound field expansion process unit 1. The horizontal direction sound field expansion process unit 1 picks up the delay component and the reverberation component between the channels originally included in the inputted right signal R and left signal L, as a difference signal between the channels. The horizontal direction sound field expansion process unit 1 gives the phase delay process to this picked up difference signal, by the phase delay circuit, etc., and adds it to the original right signal R and the left signal L by an arbitrary ratio. Then, it outputs thus processed signals as the expanded right signal RW and the expanded left signal LW, which create pseudo-expanded sound in the horizontal direction. The expanded right signal RW and the expanded left signal LW, are inputted into the vertical direction sound field expansion process unit 2.

The vertical direction sound field expansion process unit 2 generates, from the inputted expanded right signal RW, a horizontally and vertically expanded right signal RHV (which is equivalent to the upper right signal RA and the lower right signal RB in FIG. 3), in a pseudo-generating manner, and outputs it to the front and rear direction sound field expansion process unit 17. On the other hand, the vertical direction sound field expansion process unit 2 generates a horizontal and vertical expanded left signal LHV (which is equivalent to the upper left signal LA and the lower left signal LB in FIG. 3) from the expanded left signal LW in a pseudo-generating manner, and outputs it to the front and rear direction sound field expansion process unit 17.

The front and rear direction sound field expansion process unit 17 generates a front upper right signal RAF, a front lower right signal RBF, a rear upper right signal RAR, and a rear lower right signal RBR from the horizontally and vertically expanded right signal RHV. It also generates a front upper left signal LAF, a front lower left signal LBF, a rear upper left signal LAR and a rear lower left signal LBR from the horizontally and vertically expanded left signal LHV.

As a result, the front upper right signal RAF is power-amplified by an amplifier AMP 18, and is supplied to a front upper right speaker 26. The front lower right signal RBF is power-amplified by an amplifier AMP 19, and is supplied to a front lower right speaker 27. The front upper left signal LAF is power-amplified by an amplifier AMP 20, and is supplied to a front upper left speaker 28. The front lower left signal LBF is power-amplified by an amplifier AMP 21, and is supplied to a front lower left speaker 29.

Similarly, the rear upper right signal RAR is power-amplified by an amplifier AMP 22, and is supplied to a rear upper right speaker 30. The rear lower right signal RBR is power-amplified by an amplifier AMP 23, and is supplied to a rear lower right speaker 31. The rear upper left signal LAR is power-amplified by an amplifier AMP 24, and is supplied to a rear upper left speaker 32. The rear lower left signal LBR is power-amplified by an amplifier AMP 25, and is supplied to a rear lower left speaker 33.

At this time, the sounds emitted from the front upper right speaker 26, the front lower right speaker 27, the front upper left speaker 28, the front lower left speaker 29, the rear upper right speaker 30, the rear lower right speaker 31, the rear upper left speaker 32, and the rear lower left speaker 33, reach both of the listener's ears. Thus, the sound acts so that the listener may feel the sound were spread in the right and left direction more widely than the actual arrangement interval of the right speaker group 26, 27, 30, 31 and the left speaker group 28, 29, 32, 33. At the same time, the sound acts so that the listener may feel the sound were spread in the upper and lower direction more widely than the actual arrangement interval of the upper speaker group 26, 28, 30, 32, and the lower speaker group 27, 29, 31, 33. Further, the sound acts so that the listener may feel the sound were spread in the front and rear direction more widely than the actual arrangement interval of the front speaker group 26, 27, 28, 29, and the rear speaker group 30, 31, 32, 33, as indicated by arrows FRR and FRL in FIG. 15. As the result, the ampler feeling of concert hall presence and thus the ampler feeling of three dimensional sound field, can be obtained by the listener such that he feels as if he would listen to the actual live performance.

Figure 14:
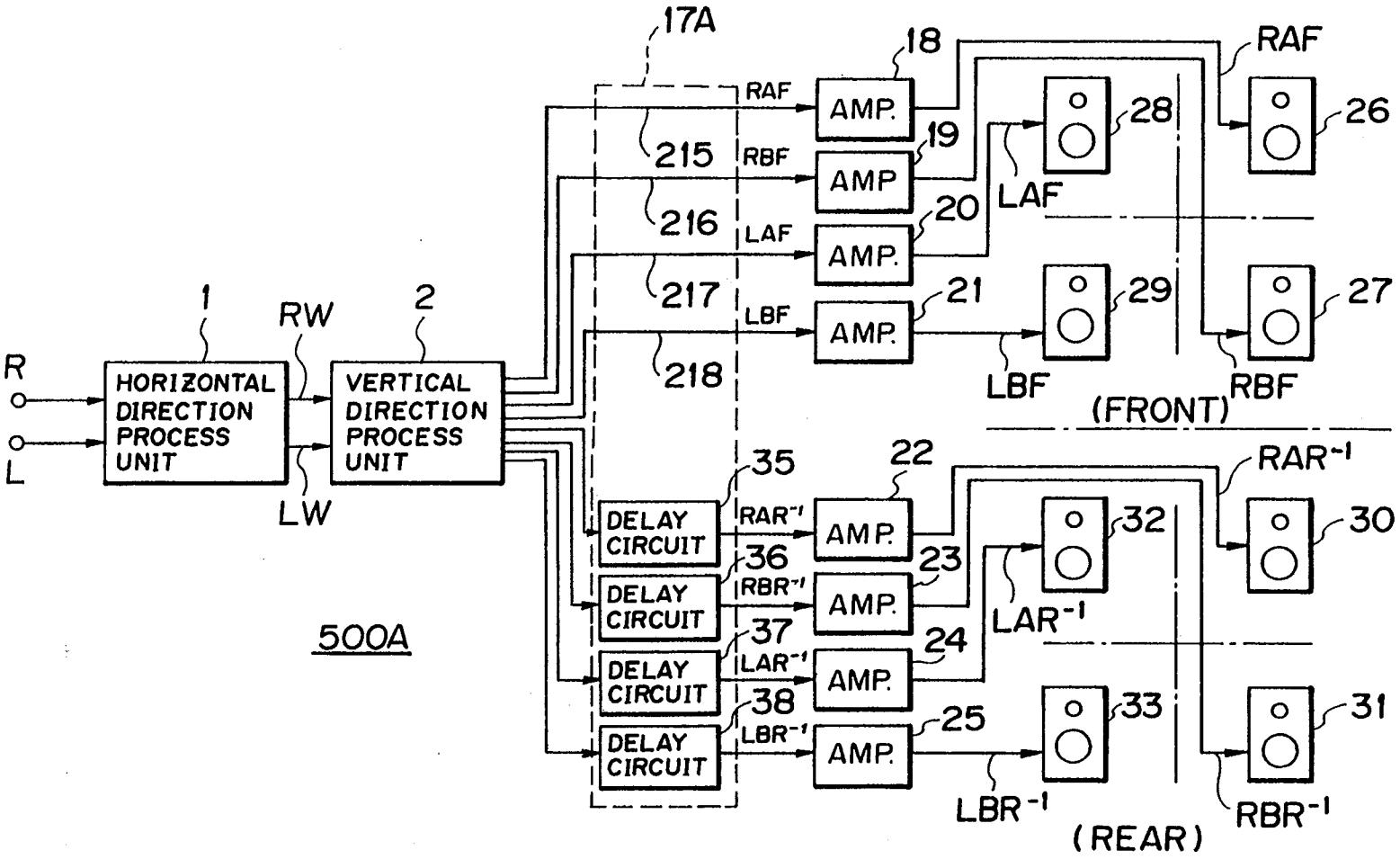
FIG. 14 is a block diagram which indicates one constitutional example of the fifth embodiment.
Figure 15:
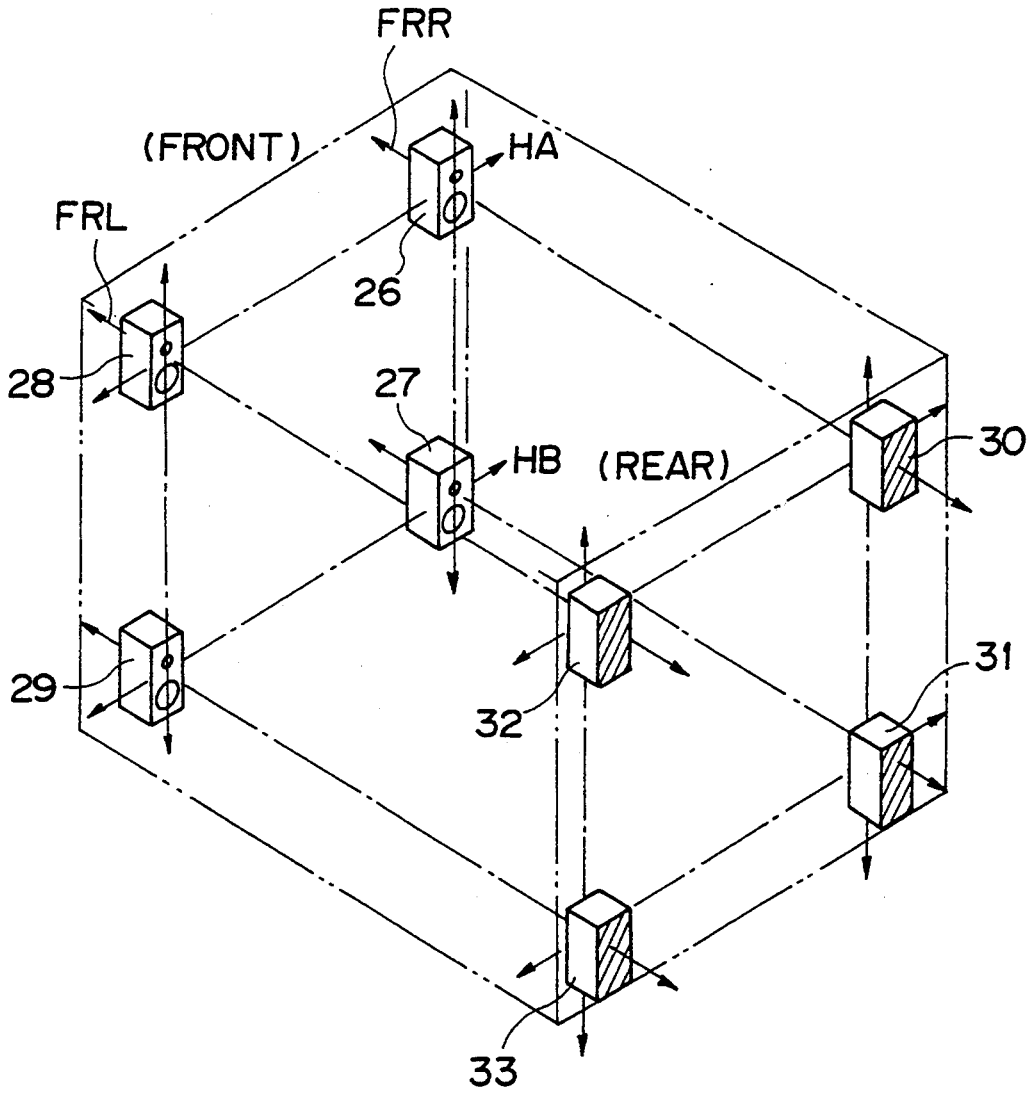
FIG. 15 is a figure explaining an operation of the fifth embodiment.

FIG. 14 is a block diagram Which indicates one example of constitution of the fifth embodiment. This example has delay circuit group which delay the signals outputted to the rear speaker group, as a front and rear direction sound field expansion process unit.

The front and rear direction sound field expansion process unit 17A has signal lines 215, 216, 217 and 218. The signal lines 215, 216, 217 and 218 output the upper right signal RA, the lower right signal RB, the upper left signal LA and the lower left signal LB from the vertical direction sound field expansion process unit 2, as the front upper right signal RAF, the front lower right signal RBF, the front upper left signal LAF and the front lower left signal LBF without processing, respectively. The front and rear direction sound field expansion process unit 17A has delay circuits 35 to 38.

The delay circuit 35 delays the rear upper right signal RAR by a predetermined time, and output it as a rear upper right signal $RAR^{-1}$. The delay circuit 36 delays the rear lower right signal RBR by a predetermined time, and outputs it as a rear lower right signal $RBR^{-1}$. The delay circuit 37 delays the rear upper left signal LAR by a predetermined time, and outputs it as a rear upper left signal $LAR^{-1}$. The delay circuit 38 delays the rear lower left signal LBR by a predetermined time, and outputs it as a rear lower left signal $LBR^{-1}$.

By constituting in this manner, the rear upper right delay signal $RAR^{-1}$ can be delayed with respect to the front upper right signal RAF. The rear lower right delay signal $RBR^{-1}$ can be delayed with respect to the front lower right signal RBF. The rear upper left delay signal $LAR^{-1}$ can be delayed with respect to the front upper left signal LAF. The rear lower left delay signal $LBR^{-1}$ can be delayed with respect to the front lower left signal LBF. Since the sound field spreads in the front and rear direction in addition to the effect of the second embodiment, it becomes possible to obtain the ampler feeling of concert hall presence and sound field.

Figure 16:
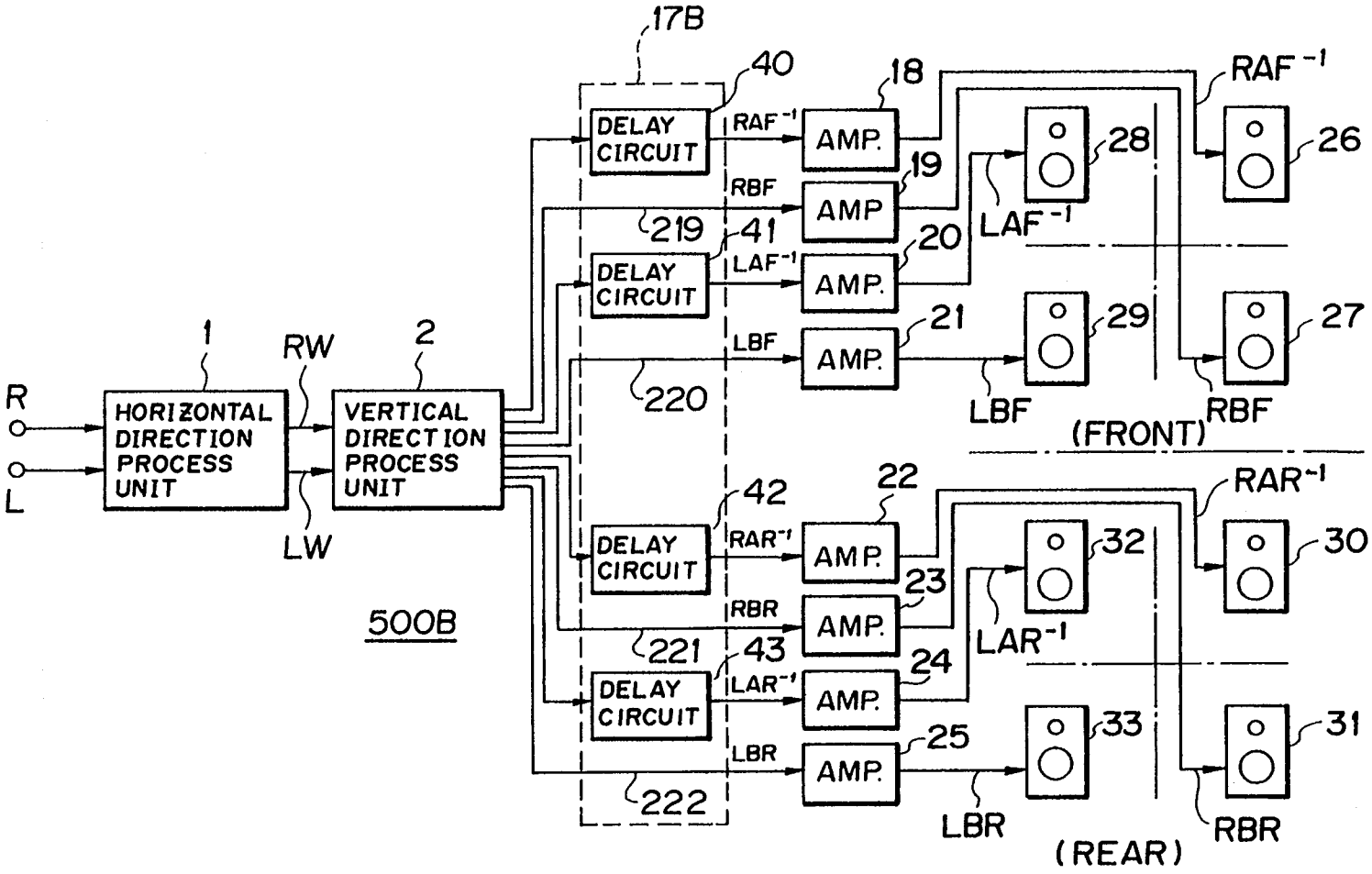
FIG. 16 is a block diagram which indicates another constitutional example of the fifth embodiment.

FIG. 16 is a block diagram which indicates another example of constitution of the fifth embodiment. This example has delay circuit group which delay the signals outputted to the upper speaker group, as a front and rear direction sound field expansion process unit.

A front and rear direction sound field expansion process unit 17B has signal lines 219, 220, 221 and 222, and delay circuits 40 to 43.

The signal lines 219 and 220 output the lower right signal RB and the lower left signal LB from the vertical direction sound field expansion process unit 2, as a front lower right signal RBF and a front lower left signal LBF, respectively. The signal lines 221 and 222 output the lower right signal RB and the lower left signal LB as a back lower right signal RBR and a back lower left signal LBR, respectively. The delay circuit 40 delays the upper right signal RA by a predetermined time, and outputs it as a front upper right delay signal $RAF^{-1}$. The delay circuit 41 delays the upper left signal LA by a predetermined time, and outputs it as a front upper left delay signal $LAF^{-1}$. The delay circuit 42 delays the upper right signal RA by a predetermined time, and outputs it as a rear upper right delay signal $RAR^{-1}$. The delay circuit 43 delays the upper left signal LA by a predetermined time, and outputs it as a rear upper left delay signal $LAR^{-1}$.

By constituting in this manner, the front upper right delay signal $RAF^{-1}$ can be delayed with respect to the front lower right signal RBF. The front upper left delay signal $LAF^{-1}$ can be delayed with respect to the front lower left signal LBF. The rear upper right delay signal $RAR^{-1}$ can be delayed with respect to the rear lower right signal RBR. The rear upper left delay signal $LAR^{-1}$ can be delayed with respect to the rear lower left signal LBR. As the result, in addition to the effect of the second embodiment, the sound field spreads in the front and rear direction. It becomes possible to obtain the ampler feeling of concert hall presence and the sound field.

As explained above in detail, the stereo reproduction apparatuses in the present embodiments, perform the surround process to the stereo audio signal of right and left two channels. The stereo surround systems output at least two kinds of surround signals with respect to the stereo audio signal of each channel on either side to the speakers. The surround signals for the side of the right channel among the surround signals, are supplied to the right-hand side speaker group. The right-hand side speaker group convert at least two kinds of surround signals into the sound waves, and emit them to space. The surround signals for the side of the left channel among surround signals are supplied to the left-hand side speaker group. The left-hand side speaker group convert at least two kinds of surround signals into the sound wave, and emit them to space.

In this manner, at least two kinds of surround processes in which the direction of the sound field expansion differs to each other, are performed, while the reproduction operation is performed. As the result, it is possible to pseudo-expand the sound field in a three dimensional manner, and perform the reproduction with the feeling of the sound field and the concert hall presence.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A stereo surround system, to which stereo audio signals of right and left channels are inputted, comprising:

a right side speaker group including at least two speakers arranged vertically;

a left side speaker group arranged at a left side of said right side speaker group, and including at least two speakers arranged vertically; and a process means, coupled to said right side speaker group and said left side speaker group, for processing the inputted stereo audio signal of the right channel to generate at least two kinds of separated surround signals to said right side speaker group such that one surround signal is supplied to one speaker and another surround signal is supplied to another speaker in said right side speaker group, and for processing the inputted stereo audio signal of the left channel to generate at least two kinds of separated surround signals to said left side speaker group such that one surround signal is supplied to one speaker and another surround signal is supplied to another speaker in said left side speaker group.

2. A stereo surround system as set forth in claim 1, wherein said process means comprises means for performing a process to expand a sound field of said right side speaker group in a vertical direction, and means for performing a process to expand a sound field of said left side speaker group in a vertical direction.

3. A stereo surround system as set forth in claim 2, wherein said process means comprises means for performing a process to expand a sound field between said right side speaker group and said left side speaker group in a horizontal direction.

4. A stereo surround system as set forth in claim 1, wherein said process means comprises means for performing a process to expand a sound field between said right side speaker group and said left side speaker group in a horizontal direction.

5. A stereo surround system as set forth in claim 1, wherein:

said right side speaker group includes a right upper speaker and a right lower speaker;

said left side speaker group includes a left upper speaker and a left lower speaker; and said process means comprises means for performing a process to expand a sound field between said right upper speaker and said left lower speaker, and means for performing a process to expand a sound field between said right lower speaker and said left upper speaker.

6. A stereo surround system as set forth in claim 1, wherein said process means comprises: one initial reflective sound generation means for adding a signal component corresponding to an initial reflective sound to one of the surround signals for said right side speaker group; and another initial reflective sound generation means for adding a signal component corresponding to an initial reflective sound to one of the surround signals for said left side speaker group.

7. A stereo surround system as set forth in claim 1, further comprising an amplifier means disposed between said process means and each of said right and left side speaker groups, for amplifying the surround signals outputted from said process means.

8. A stereo surround system, to which stereo audio signals of right and left channels are inputted, comprising:

a right side speaker group including at least two speakers arranged vertically;

a left side speaker group arranged at a left side of said right side speaker group, and including at least two speakers arranged vertically; and a process means, coupled to said right side speaker group and said left side speaker group, for processing the inputted stereo audio signal of the right channel to generate at least two kinds of surround signals to said right side speaker group, and for processing the inputted stereo audio signal of the left channel to generate at least two kinds of surround signals to said left side speaker group, wherein:

said right side speaker group includes a right front speaker and a right rear speaker;

said left side speaker group includes a left front speaker and a left rear speaker; and said process means comprises means for performing a process to expand a sound field between said right front speaker and said right rear speaker, and means for performing a process to expand a sound field between said left front speaker and said left rear speaker.

9. A stereo surround system, to which stereo audio signals of right and left channels are inputted, comprising:

a right side speaker group including at least two speakers arranged vertically;

a left side speaker group arranged at a left side of said right side speaker group, and including at least two speakers arranged vertically; and a process means, coupled to said right side speaker group and said left side speaker group, for processing the inputted stereo audio signal of the right channel to generate at least two kinds of surround signals to said right side speaker group, and for processing the inputted stereo audio signal of the left channel to generate at least two kinds of surround signals to said left side speaker group, wherein said process means comprises: one simulated stereo circuit to give a phase difference to one of the surround signals for said right side speaker group with respect to another of the surround signals for said right side speaker group; and another simulated stereo circuit to give a phase difference to one of the surround signals for said left side speaker group with respect to another of the surround signals for said left side speaker group.

10. A stereo surround system, to which stereo audio signals of right and left channels are inputted, comprising:

a right side speaker group including at least two speakers arranged vertically;

a left side speaker group arranged at a left side of said right side speaker group, and including at least two speakers arranged vertically; and a process means, coupled to said right side speaker group and said left side speaker group, for processing the inputted stereo audio signal of the right channel to generate at least two kinds of surround signals to said right side speaker group, and for processing the inputted stereo audio signal of the left channel to generate at least two kinds of surround signals to said left side speaker group, wherein said process means comprises: one delay circuit to give a time delay to one of the surround signals for said right side speaker group with respect to another of the surround signals for said right side speaker group; and another delay circuit to give a time delay to one of the surround signals for said left side speaker group with respect to another of the surround signals for said left side speaker group.

11. A stereo surround system, to which stereo audio signals of right and left channels are inputted, for generating surround signals to a right side speaker group and a left side speaker group, said left side speaker group being arranged at a left side of said right side speaker group, said right side speaker group including at least two speakers arranged vertically, said left side speaker group including at least two speakers arranged vertically, said stereo surround system comprising:

a right side process means for processing the inputted stereo audio signal of the right channel to generate at least two kinds of separated surround signals to said right side speaker group such that one surround signal is supplied to one speaker and another surround signal is supplied to another speaker in said right side speaker group, and a left side process means for processing the inputted stereo audio signal of the left channel to generate at least two kinds of separated surround signals to said left side speaker group such that one surround signal is supplied to one speaker and another surround signal is supplied to another speaker in said left side speaker group.

12. A stereo surround system as set forth in claim 11, wherein said right side process means comprises means for performing a process to expand a sound field of said right side speaker group in a vertical direction, and said left side process means comprises means for performing a process to expand a sound field of said left side speaker group in a vertical direction.

13. A stereo surround system as set forth in claim 11, further comprising means for performing a process to expand a sound field between said right side speaker group and said left side speaker group in a horizontal direction.

14. A stereo surround system, to which stereo audio signals of right and left channels are inputted, for generating surround signals to a right side speaker group and a left side speaker group, said left side speaker group being arranged at a left side of said right side speaker group, said right side speaker group including at least two speakers arranged vertically, said left side speaker group including at least two speakers arranged vertically, said stereo surround system comprising:

a right side process means for processing the inputted stereo audio signal of the right channel to generate at least two kinds of surround signals to said right side speaker group; and a left side process means for processing the inputted stereo audio signal of the left channel to generate at least two kinds of surround signals to said left side speaker group, wherein:

said right side speaker group includes a right front speaker and a right rear speaker;

said left side speaker group includes a left front speaker and a left rear speaker;

said right side process means comprises means for performing a process to expand a sound field between said right front speaker and said right rear speaker; and said left side process means comprises means for performing a process to expand a sound field between said left front speaker and said left rear speaker.

* * * * *